US011506211B2

(12) United States Patent
Li et al.

(10) Patent No.: US 11,506,211 B2
(45) Date of Patent: Nov. 22, 2022

(54) COUNTER-ROTATING FAN

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Shuqi Li, Foshan (CN); Hui Zhang, Foshan (CN); Jizhe Zhang, Foshan (CN)

( * ) Notice: Subject to any disclaimer, the term of this patent is extended or adjusted under 35 U.S.C. 154(b) by 0 days.

(21) Appl. No.: 17/283,534

(22) PCT Filed: Dec. 21, 2018

(86) PCT No.: PCT/CN2018/122549
§ 371 (c)(1),
(2) Date: Apr. 7, 2021

(87) PCT Pub. No.: WO2020/077814
PCT Pub. Date: Apr. 23, 2020

(65) Prior Publication Data

US 2021/0388839 A1 Dec. 16, 2021

(30) Foreign Application Priority Data

Oct. 15, 2018 (CN) ..... 201811198045.9

(51) Int. Cl.
*F04D 19/02* (2006.01)
*F04D 25/16* (2006.01)
*F04D 29/54* (2006.01)

(52) U.S. Cl.
CPC ..... *F04D 19/024* (2013.01); *F04D 25/166* (2013.01); *F04D 29/541* (2013.01)

(58) Field of Classification Search
CPC .... F04D 19/024; F04D 19/002; F04D 19/007; F04D 25/08; F04D 29/541; F04D 29/30
See application file for complete search history.

(56) References Cited

U.S. PATENT DOCUMENTS 2,936,948 A * 5/1960 Eck ..... F04D 19/002 415/218.1
7,156,611 B2 * 1/2007 Oosawa ..... F04D 19/007 415/199.5

(Continued)

FOREIGN PATENT DOCUMENTS

CN 1403718 A 3/2003
CN 1614242 A 5/2005

(Continued)

OTHER PUBLICATIONS

Farlex. (Apr. 2005). Hemisphere. The Free Dictionary. Retrieved Mar. 24, 2022, from https://www.thefreedictionary.com/hemisphere (Year: 2005).*

(Continued)

*Primary Examiner* — Topaz L. Elliott
*Assistant Examiner* — Jackson N Gillenwaters
(74) *Attorney, Agent, or Firm* — Kilpatrick Townsend & Stockton, LLP

(57) ABSTRACT

A counter-rotating fan, comprising an impeller assembly and an air guide structure. The impeller assembly comprises a first stage impeller and a second stage impeller, of which the rotation directions are opposite. The pressure surfaces of first blades of the first stage impeller are configured to be opposite the suction surfaces of second blades of the second stage impeller, and from the blade root to the blade tip, each of the first blades and the second blades bends toward its own rotation direction. The air guide structure comprises a flow guide cover. The flow guide cover is provided at the center position of the air intake side of the first stage (Continued)

impeller, and the air intake side surface of the flow guide cover at least partially forms a flow guide surface, the flow guide surface extending along the axis of the first stage impeller in the direction away from the counter-rotating fan.

16 Claims, 13 Drawing Sheets

(56) References Cited

U.S. PATENT DOCUMENTS

| | | | | |
|---|---|---|---|---|
| 7,909,568 | B2 * | 3/2011 | Ishihara | F04D 29/626 415/214.1 |
| 11,022,128 | B2 * | 6/2021 | Inouchi | F04D 25/0613 |
| 11,022,129 | B2 * | 6/2021 | Yao | F04D 29/384 |
| 2008/0031722 | A1 * | 2/2008 | Yoshida | F04D 19/007 415/68 |
| 2009/0047118 | A1 | 2/2009 | Ishihara et al. | |
| 2009/0263238 | A1 * | 10/2009 | Jarrah | F04D 29/544 415/199.5 |
| 2011/0174011 | A1 | 7/2011 | Kim et al. | |
| 2012/0003097 | A1 * | 1/2012 | Cho | F04D 29/328 416/189 |
| 2014/0245776 | A1 | 9/2014 | Choi et al. | |
| 2018/0087527 | A1 | 3/2018 | Dossner et al. | |
| 2020/0217322 | A1 * | 7/2020 | Chang | F04D 29/386 |
| 2021/0156393 | A1 * | 5/2021 | Bourcier | F04D 29/563 |

FOREIGN PATENT DOCUMENTS

| | | | | |
|---|---|---|---|---|
| CN | 1971065 | A | 5/2007 | |
| CN | 201615072 | U | 10/2010 | |
| CN | 102227562 | A | 10/2011 | |
| CN | 101379300 | B | 11/2011 | |
| CN | 202628549 | U | 12/2012 | |
| CN | 104235065 | A | 12/2014 | |
| CN | 106885355 | A | 6/2017 | |
| CN | 106930974 | A | 7/2017 | |
| CN | 107165863 | A | 9/2017 | |
| CN | 206785692 | U | 12/2017 | |
| CN | 107795523 | A | 3/2018 | |
| DE | 202018101941 | U1 * | 5/2018 | |
| JP | 2000320493 | A | 11/2000 | |
| JP | 2001304183 | A | 10/2001 | |
| JP | 2007263085 | A | 10/2007 | |
| JP | 2007303432 | A | 11/2007 | |
| JP | 2008014147 | A | 1/2008 | |
| JP | 4128194 | B2 | 7/2008 | |
| JP | 2010151137 | A | 7/2010 | |
| JP | 2010185443 | A | 8/2010 | |
| JP | 2013217317 | A | 10/2013 | |
| JP | 2014043780 | A | 3/2014 | |
| JP | 2014196713 | A | 10/2014 | |
| JP | 2017538908 | A | 12/2017 | |
| WO | WO-0004292 | A1 * | 1/2000 | F04D 17/06 |

OTHER PUBLICATIONS

Extended European search report of EP Application No. 18937456.4.
First Office Action of CN Application No. 201811198045.9.
Second Office Action of CN Application No. 201811198045.9.
International Search Report of PCT/CN2018/122549.
Written Opinion of ISA regarding PCT/CN2018/122549.
OA of JP Application 2021-540348.
First OA dated Jul. 19, 2022 of KR Application 10-2021-7010044.

* cited by examiner

| air flow rate/m3/h | noise if a flow guide cover is not provided/dB | noise if a flow guide cover according to the present disclosure is provided/dB |
|---|---|---|
| 1400 | 52.5 | 51.9 |
| 1350 | 51.3 | 50.8 |
| 1300 | 50.1 | 49.7 |
| 1200 | 46.7 | 46.1 |

FIG. 11

| air flow rate/m3/h | noise if a common air inlet grille is provided/dB | noise if an air inlet grille according to the present disclosure is provided/dB |
|---|---|---|
| 1400 | 52.5 | 50.9 |
| 1350 | 51.3 | 49.8 |
| 1300 | 50.1 | 48.4 |
| 1200 | 46.7 | 45.2 |

FIG. 12

| air flow rate/m3/h | rotation speed/r/min | common pressure rise/Pa | pressure rise according to the present disclosure/Pa |
|---|---|---|---|
| 1400 | 1000 | 48.6 | 78.2 |
| 1350 | 1000 | 70.3 | 110.5 |
| 1300 | 1000 | 87.4 | 135.5 |
| 1200 | 1000 | 104.3 | 165.6 |

FIG. 13

COUNTER-ROTATING FAN

CROSS-REFERENCES TO RELATED APPLICATIONS

The present disclosure is a national phase application of International Application No. PCT/CN2018/122549, filed on Dec. 21, 2018, which claims priority to Chinese Patent Application No. 201811198045.9, filed Oct. 15, 2018, the entireties of which is incorporated herein by reference.

FIELD

The present disclosure relates to the field of a fan, and in particular to a counter-rotating fan.

BACKGROUND

Compared with a widely-used multi-blade centrifugal fan, a general counter-rotating axial flow fan has characteristics of high noise and low air pressure. Particularly, when the counter-rotating axial flow fan is miniaturized, the characteristics of high noise and low air pressure become more prominent.

SUMMARY

The present disclosure seeks to solve at least one of the problems existing in the related art. For this purpose, the present disclosure proposes a counter-rotating fan capable of increasing air pressure and reducing noise after rationalization of the structural parameters of the counter-rotating fan.

The counter-rotating fan according to embodiments of the present disclosure includes: an impeller assembly, the impeller assembly including a first stage impeller and a second stage impeller, a rotation direction of the first stage impeller and a rotation direction of the second stage impeller being opposite to each other, the first stage impeller including a first hub and a plurality of first blades connected to the first hub, the second stage impeller including a second hub and a plurality of second blades connected to the second hub, pressure surfaces of the first blades facing toward suction surfaces of the second blades, each of the first blades bending toward a rotation direction of the first blades in a direction from a blade root to a blade tip of each of the first blades, each of the second blades bending toward a rotation direction of the second blades in a direction from a blade root to a blade tip of each of the second blades; and an air guide structure, the air guide structure including an air inlet grille, the air inlet grille including a plurality of supporting guide vanes arranged in a circumferential direction, the supporting guide vanes bending in a direction toward an air outlet side, a bending direction of each of the supporting guide vanes being opposite to a rotation direction of the first blades, and an inlet installation angle of each of the supporting guide vanes being smaller than an outlet installation angle of each of the supporting guide vanes.

The counter-rotating fan according to embodiments of the present disclosure ensures that the support guide vanes guide air in a direction toward an inlet of each of the first blades by providing the supporting guide vanes which bend in the direction toward the air outlet side, reducing the noise of inlet air and reducing the pressure loss to the counter-rotating fan.

According to one embodiment of the present disclosure, the air guide structure includes a flow guide cover provided at a center position of an air inlet side of the first stage impeller. At least a portion of an air inlet side surface of the flow guide cover forms a flow guide surface, which extends away from an axis of the counter-rotating fan in a direction toward the first stage impeller.

According to one embodiment of the present disclosure, the flow guide surface is a hemispherical surface. A diameter of the hemispherical surface is at least 0.8 times a diameter of the first hub at an air inlet side of the first hub, and the diameter of the hemispherical surface is at most 1.1 times the diameter of the first hub at the air inlet side of the first hub.

According to one embodiment of the present disclosure, the inlet installation angle of each of the supporting guide vanes is 0°, and the outlet installation angle of each of the supporting guide vanes is at least 18° and is at most 42°.

According to one embodiment of the present disclosure, the supporting guide vane bends from a root to a tip of the supporting guide vane in a direction opposite to the rotation direction of the first blades. If an angle of 360° is averagely divided into multiple subangles with the number equal to the number of the supporting guide vanes, an average angle is equal to an angle value of each subangle. The average angle is at least 4° greater than a bending angle of each supporting guide vane, and is at most 15° greater than the bending angle of each supporting guide vane.

According to one embodiment of the present disclosure, a diameter of the first hub is gradually increased in a direction from an air inlet side to an air outlet side of the first hub. Herein, a diameter of the first hub at the air inlet side thereof is at least 0.5 times a diameter of the first hub at the air outlet side thereof, and is at most 0.85 times the diameter of the first hub at the air outlet side thereof. Moreover, the diameter of the first hub at the air outlet side thereof is at least 0.25 times a diameter of a rim of the first stage impeller, and is at most 0.45 times the diameter of the rim of the first stage impeller.

According to one embodiment of the present disclosure, a hub ratio of the second stage impeller is a ratio of a diameter of the second hub to a diameter of a rim of the second stage impeller. The hub ratio of the second stage impeller is at least 0.45, and is at most 0.7.

According to one embodiment of the present disclosure, an inlet of each of the first blades bends backward, and a bending angle of the inlet of each of the first blades is denoted as L1, which satisfies the relation of: $5° \leq L1 \leq 12°$.

According to one embodiment of the present disclosure, an outlet of each of the first blades bends forward, and a bending angle of the outlet of each of the first blades is denoted as L2, which satisfies the relation of: $3° \leq L2 \leq 15°$.

According to one embodiment of the present disclosure, an inlet of each of the second blades bends backward, and a bending angle of the inlet of each of the second blades is denoted as L3, which satisfies the relation of: $5° \leq L3 \leq 10°$.

According to one embodiment of the present disclosure, an outlet of each of the second blades bends forward, and a bending angle of the outlet of each of the second blades is denoted as L4, which satisfies the relation of: $3° \leq L4 \leq 8°$.

According to one embodiment of the present disclosure, a difference between an outlet angle of each of the second blades and an inlet angle of each of the first blades is at most 10°, and a difference between an inlet angle of each of the second blades and a reference angle of each of the first blades is at most 5°. Herein, the reference angle of each of the first blades is an arctangent function angle of a tangential value of the inlet angle of each of the first blades after referencing to flow coefficients.

According to one embodiment of the present disclosure, an axial width of each of the first blades is at least 1.4 times an axial width of each of the second blades, and is at most 3 times the axial width of each of the second blades.

According to one embodiment of the present disclosure, an axial gap between each first blade and each second blade is at least 0.1 times an axial width of each of the first blades, and is at most 0.8 times the axial width of each of the first blades.

According to one embodiment of the present disclosure, a diameter of the first hub at the air outlet side of the first hub is at least 0.9 times a diameter of the second hub, and is at most 1.1 times the diameter of the second hub.

According to one embodiment of the present disclosure, the number of the first blades is greater than or equal to the number of the second blades minusing 3, and is less than or equal to a sum of the number of the second blades and 5.

According to one embodiment of the present disclosure, the impeller assembly includes multiple sets of impellers arranged in an axial direction.

According to one embodiment of the present disclosure, a profile of each first blade is different from a profile of each second blade.

According to one embodiment of the present disclosure, a diameter of a rim of each of the first blades is equal to a diameter of a rim of each of the second blades, or the diameter of a rim of each of the first blades is not equal to a diameter of the rim of each of the second blades.

Additional aspects and advantages of the present disclosure will be given in part in the following description, become apparent in part from the following description, or be learned from the practice of the present disclosure.

BRIEF DESCRIPTION OF THE DRAWINGS

These and/or other aspects and advantages of the present disclosure will become apparent and more readily appreciated from the following description made with reference to the drawings, in which:

FIG. 11 is a table showing noise test data of a flow guide cover of an embodiment of the present disclosure.

FIG. 12 is a table showing noise test data of an air inlet grille of an embodiment of the present disclosure.

FIG. 13 is a table showing air pressure increase data at a same rotation speed in the present disclosure.

Figure 1:
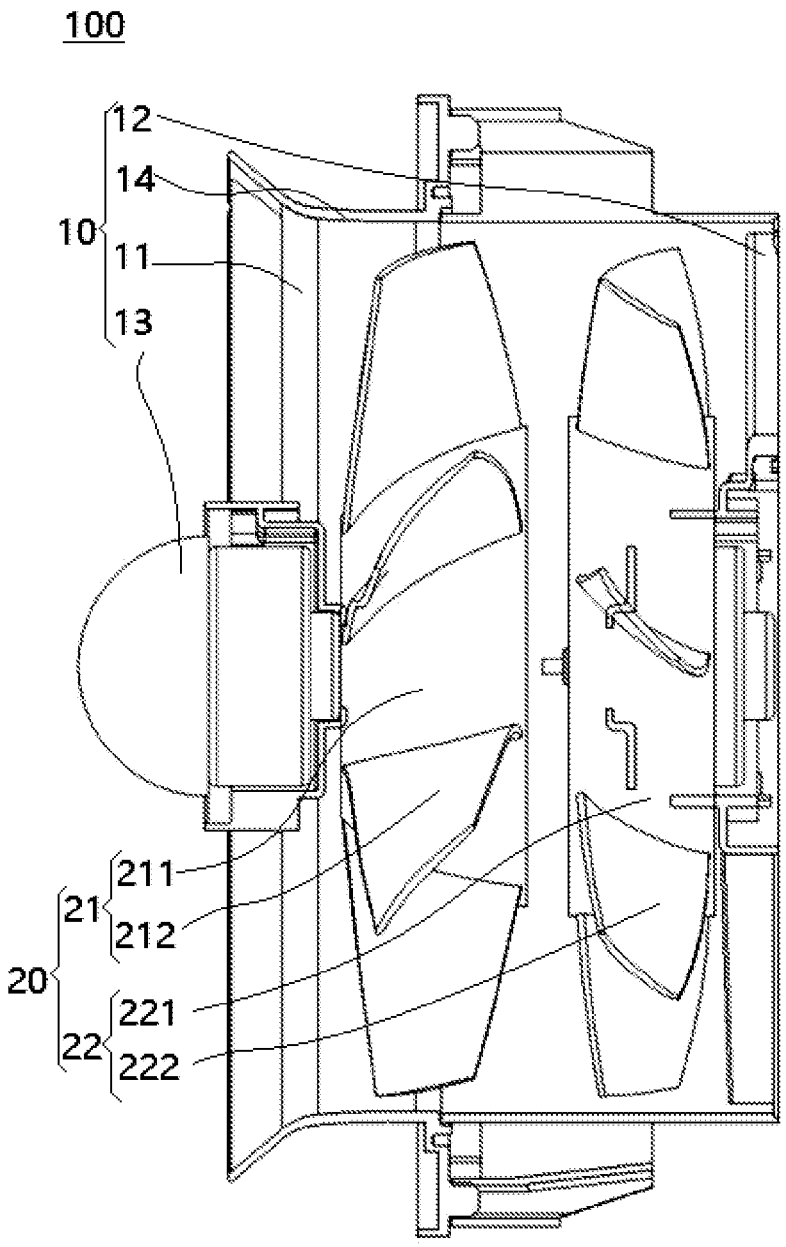
FIG. 1 is a cross-sectional diagram of an air duct of a counter-rotating fan of an embodiment of the present disclosure.

REFERENCE NUMERALS counter-rotating fan 100;
air guide structure 10; air inlet grille 11; supporting guide vane 111; air outlet grille 12; flow guide cover 13; air barrel 14; impeller assembly 20;
first stage impeller 21; first hub 211; first blade 212;
second stage impeller 22; second hub 221; second blade 222.

DETAILED DESCRIPTION OF THE DISCLOSURE

Embodiments of the present disclosure are described in detail, and examples of the embodiments are depicted in the drawings. The same or similar elements and the elements having same or similar functions are denoted by like reference numerals throughout the description. The embodiments described herein with reference to drawings are explanatory and only used to illustrate the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present disclosure be constructed or operated in a particular orientation, which shall not be construed to limit the present disclosure. In addition, terms such as "first" and "second" are used herein for purposes of description and are not intended to indicate or imply relative importance or significance or to imply the number of indicated features. Thus, the feature defined with "first" and "second" may indicate or imply that one or more of this feature is included. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements.

A counter-rotating fan 100 according to embodiments of the present disclosure is described referring to FIG. 1 to FIG. 13.

As shown in FIG. 1, the counter-rotating fan 100 according to embodiments of the present disclosure includes an air guide structure 10 and an impeller assembly 20.

The impeller assembly 20 includes a first stage impeller 21 and a second stage impeller 22, and a rotation direction of the first stage impeller 21 and a rotation direction of the second stage impeller 22 are opposite to each other. The first stage impeller 21 includes a first hub 211 and a plurality of first blades 212 connected to the first hub 211, and the second stage impeller 22 includes a second hub 221 and a plurality of second blades 222 connected to the second hub 221. Pressure surfaces of the first blades 212 faces toward suction surfaces of the second blades 222. Herein, it should be noted that both the pressure surfaces and the suction surfaces are common-used structural names of the blades known in the art. A side corresponding to the pressure surface of each blade on the impeller is an air outlet side of the impeller, and a side corresponding to the suction surface of each blade on the impeller is an air inlet side of the impeller.

That is, when the counter-rotating fan 100 is in operation, the direction of the air flow is substantially consistent with the direction from the first stage impeller 21 to the second stage impeller 22. Each of the first blades 212 bends toward its rotation direction in a direction from a blade root to a blade tip of each of the first blades 212. Each of the second blades 222 bends toward its rotation direction in a direction from a blade root to a blade tip of each of the second blades 222. That is, the bending direction of each of the first blades 212 is opposite to the bending direction of each of the second blades 222.

In embodiments of the present disclosure, the first stage impeller 21 and the second stage impeller 22 of the counter-rotating fan 100 are configured to rotate opposite to each other, to affect the wind field of the second stage impeller 22 with the wind field generated by the rotation of the first stage impeller 21. This can not only change the outlet air pressure of the second stage impeller 22, but also change the air speed and the spreading cone angle of the wind field of the second stage impeller 22, and even the vortex conditions. When the second stage impeller 22 rotates, a circumferential vortex-like airflow is formed. When the first stage impeller 21 and the second stage impeller 22 rotate simultaneously, under the influence of the wind field of the first stage impeller 21, the circumferential vortex-like airflow formed by the rotation of the second stage impeller 22 may have the phenomenon of de-rotation and endurance.

It should be noted that the counter-rotating fan 100 of embodiments of the present disclosure can be applied to devices that need to discharge air, such as electric fans, circulating fans, ventilating fans, air-conditioning fans, etc. The counter-rotating fan 100 of embodiments of the present disclosure is mainly used to promote airflow instead of exchange heat.

As shown in FIG. 1, the air guide structure 10 includes an air inlet grille 11 arranged adjacent to the first stage impeller 21. The air inlet grille 11 includes a plurality of supporting guide vanes 111 arranged in a circumferential direction. The air inlet grille 11 not only serves to support, but also to guide air.

In one embodiment, the supporting guide vanes 111 bend in a direction toward the air outlet side. A bending direction of each of the supporting guide vanes 111 is opposite to the rotation direction of the first blades 212. An inlet installation angle of each of the supporting guide vanes 111 is denoted as W0, and an outlet installation angle of each of the supporting guide vanes 111 is denoted as W1. W0 and W1 satisfy the relation of: W0<W1.

Herein, since the air inlet grille 11 and the first stage impeller 21 rotate opposite to each other, and the air inlet grille 11 includes a plurality of supporting guide vanes 111 arranged in the circumferential direction, the air inlet grille 11 can be regarded as an air guide rotor, and the supporting guide vanes can be regarded as blades of the air guide rotor. Since the bending direction of each of the supporting guide vanes 111 is opposite to the rotation direction of the first blades 212, the air inlet grille 11 can be regarded as an air guide rotor with a rotation direction opposite to that of the first stage impeller 21.

Herein, the support guide vanes 111 bend in an axial direction. In order to further define the bending characteristics of the supporting guide vanes 111, the inlet installation angle W0 of each of the supporting guide vanes 111 and the outlet installation angle W1 of each of the supporting guide vanes 111 are provided. The names of the inlet installation angle and the outlet installation angle of each of the supporting guide vanes 111 are derived from the inlet angle and outlet angle of the blade. That is, the supporting guide vanes 111 correspond to blades, the inlet installation angle of each of the supporting guide vanes 111 corresponds to the inlet angle of the blade, and the outlet installation angle of each of the supporting guide vanes 111 corresponds to the outlet angle of the blade.

Both the inlet angle and outlet angle of the blade are common-used structural names of the blades known in the art. The blade angle of the blade at the inlet is regarded as an inlet angle of the blade, and the blade angle of the blade at the outlet is regarded as an outlet angle of the blade.

Hereinafter, it is illustrated how to calculate the inlet installation angle W0 of each of the supporting guide vanes 111 and the outlet installation angle W1 of each of the supporting guide vanes 111. The inlet angle and outlet angle of the first blade 212 and the second blade 222 mentioned below are also calculated in the same way as the inlet installation angle W0 and the outlet installation angle W1. The calculation of the inlet angle and the outlet angle will be omitted here.

The inlet installation angle W0 of each of the supporting guide vanes 111 is equal to an angle between the tangent of a central arced curve of the supporting guide vane 111 at the air inlet end and the axis of the fan. The outlet installation angle W1 of each of the supporting guide vanes 111 is equal to an angle between the tangent of the central arced curve of the supporting guide vane 111 at the air outlet end and the axis of the fan.

Figure 2:
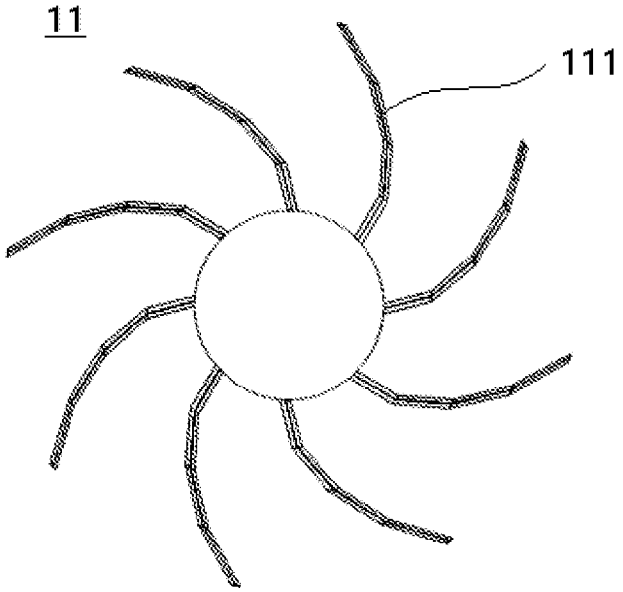
FIG. 2 is a front view of an air inlet grille of the present disclosure.
Figure 3:
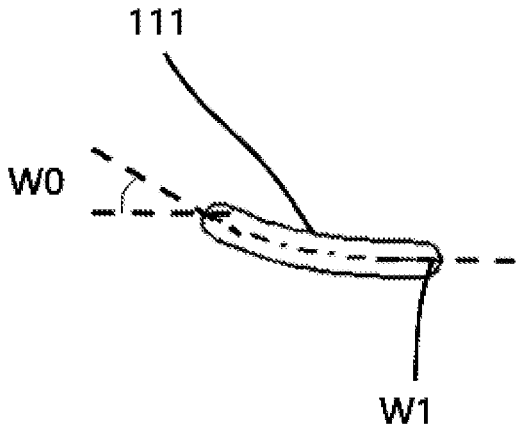
FIG. 3 is a cross-sectional diagram of a profile of an air inlet grille of the present disclosure.

Taking the air inlet grille 11 shown in FIG. 2 and FIG. 3 as an example, the central arced curve of the supporting guide vane 111 is an intersection line between a central arced surface of the supporting guide vane 111 and a reference cylindrical surface. The reference cylindrical surface is a cylindrical surface coaxial with the axis of the fan, the opposite surfaces at both sides of the supporting guide vane 111 are airfoils, and the central arced surface of the supporting guide vane 111 is an equidistant reference surface between the airfoils at both sides of the supporting guide vane. The approximate racetrack shape shown in FIG. 3 refers to a cross section formed by the reference cylindrical surface on the supporting guide vane 111. The intersection line between the central arced surface of the supporting guide vane 111 and the cross section forms the central arced line shown in the figure. The tangents at both sides of the central arced line form the angle W0 and W1 with the axis of the fan, respectively.

The supporting guide vanes 111 on the air inlet grille 11 are configured to bend in the direction toward the air outlet side. Furthermore, the bending direction of each of the supporting guide vanes 111 is opposite to the rotation direction of the first blades 212, which can guide the airflow flowing toward the first stage impeller 21 in a direction opposite to the rotation direction of the first stage impeller 21, so that the wind field at the air inlet side of the first stage impeller 21 is changed. The function of the supporting guide vanes 111 of the air inlet grille 11 on the first stage impeller 21 is similar to the function of the first stage impeller 21 on the second stage impeller 22. Eventually, the influence of the supporting guide vanes 111 on the first stage impeller 21 will affect the outlet wind field of the second stage impeller 22. In this way, even if the rotation speed of the impeller assembly 20 decreases, the outlet air pressure can be increased.

In order to ensure that the supporting guide vanes 111 guide air in a direction toward the inlet of each first blade 212, it is proposed here that the inlet installation angle W0 of each of the supporting guide vanes 111 is smaller than the outlet installation angle W1 of each of the supporting guide vanes 111, which not only reduces the noise of the inlet air, but also facilitates reducing the pressure loss. The counter-rotating fan 100 according to embodiments of the present disclosure ensures that supporting guide vanes 111 guide air in a direction toward an inlet of each of the first blades 212 by providing the supporting guide vanes 111 which bend in a direction toward an air outlet side, reducing the noise of the inlet air and reducing the pressure loss to the counter-rotating fan 100.

In some embodiments, the air guide structure 10 includes a flow guide cover 13 provided at a center position of the air inlet side of the first stage impeller 21. At least a portion of the air inlet side surface of the flow guide cover 13 forms a flow guide surface, which extends away from the axis of the counter-rotating fan 100 in a direction toward the first stage impeller 21.

It is understood that on the radial surface (the surface perpendicular to the axis of the fan) of the rotor, the closer to the axis of the fan is, the lower the liner speed is, and the lower the airflow pressure is. Conversely, the closer to the blade tip is, the greater the airflow pressure is. Therefore, the design of the flow guide cover 13 with a flow guide surface facilitates guiding the airflow flowing toward the first hub 211 to the first blades 212. On the one hand, it is advantageous for the airflow to keep away from the first hub 211, reducing the turbulence and noise of the airflow, and reducing the loss of the air pressure. On the other hand, the outlet air pressure can be increased by guiding the airflow to the region with greater work. The effect on such a counter-rotating fan 100 is particularly significant in the scenario where the upstream and downstream resistance is relatively large. As a result, providing a flow guide cover 13 at the center position of the air inlet side of the first stage impeller 21 can guide the inlet air of the fan to the region where the impeller assembly 20 is strongly pressurized as much as possible, to avoid excessive turbulence and noise caused by the airflow close to the blade root, facilitating increasing the air pressure of the counter-rotating fan 100 and reducing the noise.

In one embodiment, the side surface of the flow guide cover 13 away from the air inlet grille 11 is a hemispherical surface. That is, the flow guide surface is a hemispherical surface, of which the processing is the simplest. Of course, other revolving surfaces, such as ellipsoids and hyperboloids, etc., can also be selected for the flow guide surface, which is not limited herein.

Figure 5:
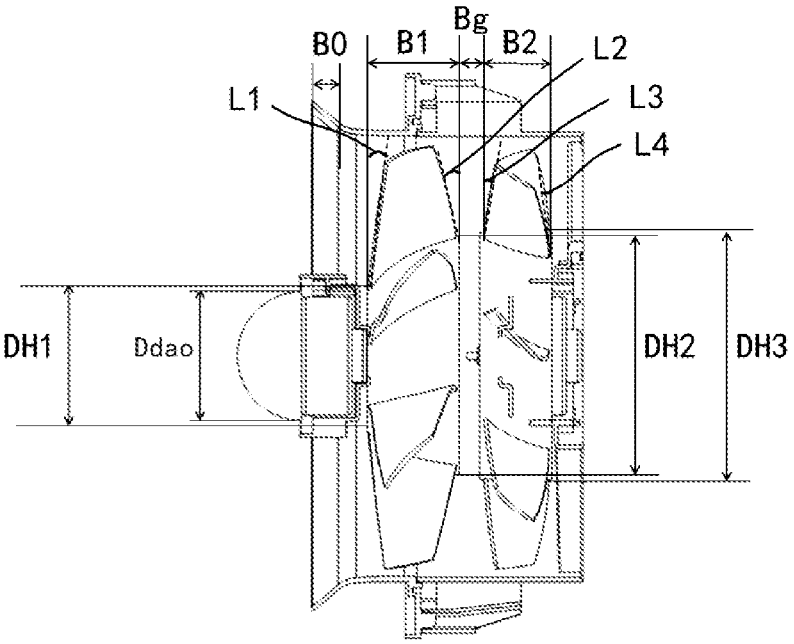
FIG. 5 is a schematic diagram showing parameters of a counter-rotating fan of an embodiment of the present disclosure.
Figure 6:
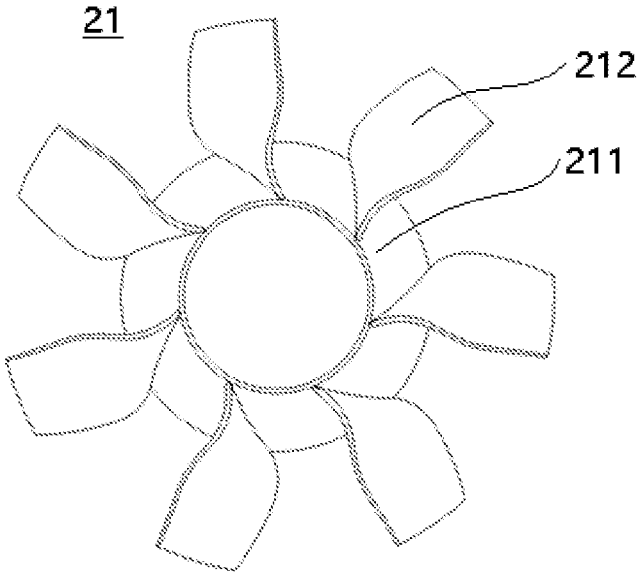
FIG. 6 is a front view of a first stage impeller of an embodiment of the present disclosure.
Figure 7:
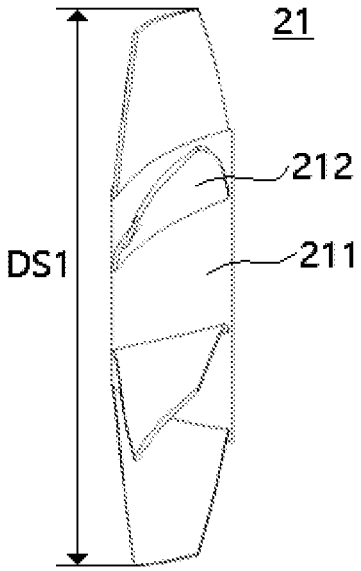
FIG. 7 is a side view of a first stage impeller of an embodiment of the present disclosure.
Figure 8:
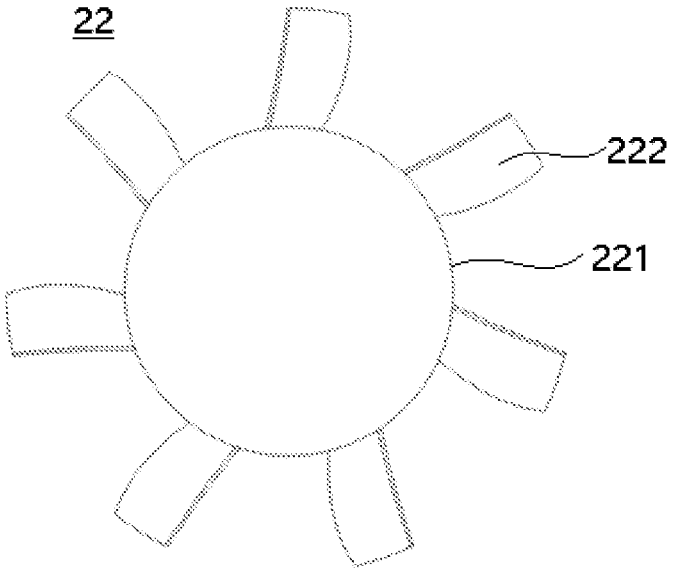
FIG. 8 is a front view of a second stage impeller of an embodiment of the present disclosure.
Figure 9:
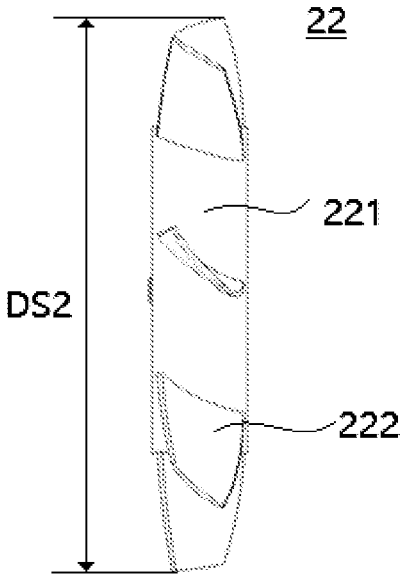
FIG. 9 is a side view of a second stage impeller of an embodiment of the present disclosure.

In one embodiment, if the flow guide surface is a hemispherical surface, a diameter of the hemispherical surface is at least 0.8 times a diameter of the first hub 211 at the air inlet side of the first hub, and the diameter of the hemispherical surface is at most 1.1 times the diameter of the first hub 211 at the air inlet side of the first hub. Referring to FIG. 5, the diameter of the hemispherical surface is denoted as Ddao, the diameter of the first hub 211 at the air inlet side of the first hub is denoted as DH1. Ddao and DH1 satisfy the relation of: $0.8*DH1 \leq Ddao \leq 1.1*DH1$. If the diameter of the hemispherical surface is too small, there is still a large air flow rate at the edge of the first hub 211, causing the loss of the air pressure and the noise. However, if the diameter of the hemispherical surface is too large, the air inlet area of the fan can be influenced, and the outlet air flow rate can be decreased. Thus, it is selected the relation of $0.8*DH1 \leq Ddao \leq 1.1*DH1$ herein, which can fully utilize the air guiding effect of the hemispherical surface, and avoid decrease of the inlet air flow rate caused by the excessive diameter. In some embodiments, the air guide structure 10 includes an air barrel 14. The air barrel 14 is formed in a cylindrical shape with an opening at both axial ends. The impeller assembly 20 is arranged in the air barrel 14. The arrangement of the air barrel 14 on the one hand can guide the air and extend the air blowing distance of the fan, on the other hand can avoid premature depressurization around the impeller assembly 20 and ensure that the outlet air pressure at the second stage impeller 22 is relatively large.

In one embodiment, the air barrel 14 is provided with an air inlet grille 11 and an air outlet grille 12 at both axial ends. The first stage impeller 21 is arranged adjacent to the air inlet grille 11, and the second stage impeller 22 is arranged adjacent to the air outlet grille 12. The arrangement of the air inlet grille 11 and the air outlet grille 12 is configured for supporting the air barrel 14. In an example shown in FIG. 1, the first stage impeller 21 is driven by a first motor, and the second stage impeller 22 is driven by a second motor. The first motor is fixed on the air inlet grille 11, and the second motor is fixed on the air outlet grille 12.

In some embodiments, the first stage impeller 21 and the second stage impeller are driven by a same motor, and one of the first stage impeller 21 and the second stage impeller is connected to a steering mechanism. In this case, the motor can be fixed on the air inlet grille 11 and the air outlet grille 12, which is not limited herein.

In one embodiment, the inlet installation angle W0 of each of the supporting guide vanes 111 is 0°, and the outlet installation angle W1 of each of the supporting guide vanes 111 satisfies the relation of $18° \leq W1 \leq 42°$. The design of the inlet installation angle and the outlet installation angle of each of the supporting guide vanes 111 is the blade profile characteristics adapted to the conventional axial flow rotor, which can maximize the influence of the air on the air pressure. It can be understood here that since the supporting guide vanes 111 are designed on the air inlet grille 11, the axial dimension of each of the supporting guide vanes 111 is not excessively large. If the outlet installation angle W1 of each of the supporting guide vanes 111 is less than 18°, the air guiding effect is excessively weak. However, if the outlet installation angle W1 of each of the supporting guide vanes 111 exceeds 42°, the air cannot fit the air inlet angle of the first stage impeller 21, which may cause airflow disturbance or other phenomenon.

In some embodiments, the supporting guide vane 111 bends from a root to a tip of the supporting guide vane in a direction opposite to the rotation direction of the first blades 212. In this way, the air inlet grille 11 has a shape similar to that of an axial flow rotor, so that the effect on the wind field is more pronounced.

Figure 4:
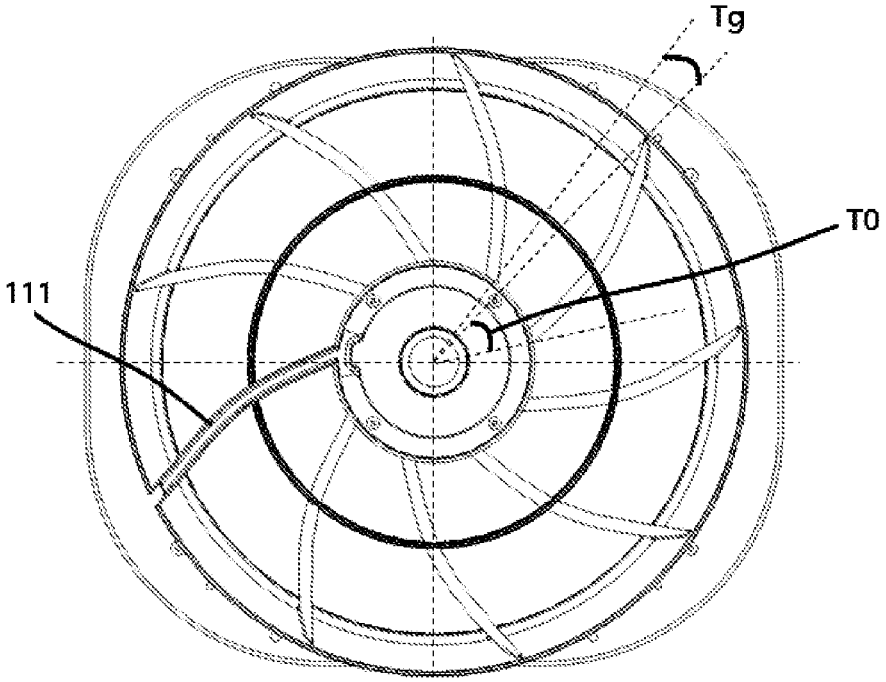
FIG. 4 is a diagram explaining definitions of parameters of an air inlet grille of the present disclosure.

In one embodiment, as shown in FIG. 4, the air inlet grille 11 has an average angle. If an angle of 360° is averagely divided into multiple subangles with the number equal to the number of the supporting guide vanes 111, an average angle is equal to an angle value of each subangle. The average angle is at least 4° greater than the bending angle of each supporting guide vane 111, and is at most 15° greater than the bending angle of each supporting guide vane 111. That is, the bending angle T0 of each supporting guide vane 111 and the number BN0 of the supporting guide vanes 111 satisfy the relation of: (360°/BN0−15°)≤T0≤(360°/BN0−4°). An gap angle Tg between two adjacent supporting guide vanes 111 satisfies the relation of: 4°≤Tg≤15°. The bending angle T0 of each of the supporting guide angle 111 here refers to a central angle between the blade root and the blade tip of each of the supporting guide vanes 111 on a same radial section (the radial section is perpendicular to the axis of the fan). The gap angle Tg of each of the supporting guide vanes 111 refers to a central angle between the blade tip of a supporting guide vane 111 and the blade root of another adjacent supporting guide vane 111 in the bending direction on a same radial section. In this way, the density of the arrangement of the supporting guide vanes 111 is limited, which can on the one hand avoid a decrease of the outlet air flow rate, and on the other hand reduce local vortices.

In some embodiments, the diameter of the first hub 211 is gradually increased in a direction from the air inlet side to the air outlet side of the first hub. The diameter of the first hub 211 at the air inlet side thereof is at least 0.5 times a diameter of the first hub 211 at the air outlet side thereof, and is at most 0.85 times the diameter of the first hub 211 at the air outlet side thereof. Moreover, the diameter of the first hub 211 at the air outlet side thereof is at least 0.25 times a diameter of a rim of the first stage impeller 21, and is at most 0.45 times the diameter of the rim of the first stage impeller 21.

In one embodiment, as shown in FIG. 5, the diameter of the first hub 211 at the air inlet side of the first hub is denoted as DH1, and the diameter of the first hub 211 at the air outlet side of the first hub is denoted as DH2. DH1 and DH2 satisfy the relation of: 0.5*DH2≤DH1≤0.85*DH2, DH2=(0.25−0.45)*DS1, in which DS1 represents the diameter of the rim of the first stage impeller 21. The diameter of the rim of the first stage impeller 21 can also be referred to as the diameter of the first stage impeller 21, that is, the diameter of a circle formed by the most distant points of a plurality of the first blades 212 on the first stage impeller 21 from the rotation axis.

The diameter of the first hub 211 is gradually increased in a direction toward the second hub 221 and the peripheral surface of the first hub 211 corresponds to another flow guide surface, which facilitates guiding the airflow flowing toward the second hub 221 to the second blades 222, reducing the turbulence and noise at the second hub 221, and further increasing the outlet air pressure.

Herein, the purpose of limiting the ratio of the diameters at both ends of the first hub 211 is to ensure that the peripheral surface of the first hub 211 can achieve a significant air guiding effect. Furthermore, if the diameter of the first hub 211 at the air inlet side thereof is excessively small, a plurality of the first blades 212 cannot be arranged. Thus, a reasonable ratio of the diameters at both ends can also ensure a reasonable arrangement of the first blades 212. The diameter of the first hub 211 and the diameter of the rim of the first stage impeller 21 are limited, which can on the one hand guarantee that the blades have sufficient sweeping area, and on the other hand avoid that the diameter of the first hub 211 is excessively small to cause a weak torsion resistance.

In some embodiments, the diameter of the second hub 221 is denoted as DH3, and the diameter of the rim of the second stage impeller 22 is denoted as DS2. The hub ratio of the second stage impeller 22 is denoted as CD2=DH3/DS2, in which CD2 satisfies the relation of: 0.45≤CD2≤0.7. Such an arrangement is advantageous for ensuring a sufficient sweeping area, and making full use of the flow guide cover 13 and other guiding structures to pressurize the airflow guided to the second blades 222 and increase the outlet air pressure. The diameter of the rim of the second stage impeller 22 can also be referred to as the diameter of the second stage impeller 22, that is, the diameter of a circle formed by the most distant points of a plurality of the second blades 222 on the second stage impeller 22 from the rotation axis.

It is well known in the art that each blade of the impeller has a leading edge and a trailing edge ("the trailing edge" can also be referred to as "the tail edge"). The fluid flows into the blade channel from the leading edge of the blade and flows out of the blade channel from the trailing edge of the blade according to the flow direction of the fluid. In the direction away from the rotation axis of the impeller, if the leading edge of the blade extends in the direction toward the air outlet side, the inlet of the blade is said to bend backward; conversely, the inlet of the blade is said to bend forward. In the direction away from the rotation axis of the impeller, if the trailing edge of the blade extends in the direction toward the air inlet side, the outlet of the blade is said to bend forward; conversely, the outlet of the blade is said to bend backward.

In some embodiments, the inlet of each of the first blades 212 bends backward. The bending angle of the inlet of each of the first blades 212 is denoted as L1, which satisfies the relation of: 5°≤L1≤12°. Herein, each of the first blades 212 has a leading edge. The intersection line between the central arced surface (that is, an equal-thickness surface) of each of the first blades 212 and the leading edge of each of the first blades 212 is a first leading edge line. An angle between the tangent to any point on the first leading edge line and the radial section (that is, a section perpendicular to the axis of the fan) is equal to L1. The inlet of each of the first blades 212 is configured to bend backward and the range of L1 is limited, which facilitates reducing the airflow resistance and generating sufficient air pressure.

In some embodiments, the outlet of each of the first blades 212 bends forward. The bending angle of the outlet of each of the first blades 212 is denoted as L2, which satisfies the relation of: 3°≤L2≤15°. Each of the first blades 212 has a trailing edge. The intersection line between the central arced surface of each of the first blades 212 and the trailing edge of each of the first blades 212 is a first trailing edge line. An angle between the tangent to any point on the first trailing edge line and said radial section is equal to L2. The outlet of each of the first blades 212 is configured to bend forward and the range of L2 is limited, which facilitates reducing the airflow resistance and generating sufficient air pressure.

In some embodiments, the inlet of each of the second blades 222 bends backward. The bending angle of the inlet of each of the second blades 222 is denoted as L3, which satisfies the relation of: 5°≤L3≤10°. Each of the second blades 222 has a leading edge. The intersection line between the central arced surface of each of the second blades 222 and the leading edge of each of the second blades 222 is a second leading edge line. An angle between the tangent to any point on the second leading edge line and said radial section is equal to L3. The inlet of each of the second blades 222 is configured to bend backward and the range of L3 is limited, which facilitates reducing the airflow resistance and generating sufficient air pressure.

In some embodiments, the outlet of each of the second blades 222 bends forward. The bending angle of the outlet of each of the second blades 222 is denoted as L4, which satisfies the relation of: 3°≤L4≤8°. Each of the second blades 222 has a trailing edge. The intersection line between the central arced surface of each of the second blades 222 and the trailing edge of each of the second blades 222 is a second trailing edge line. An angle between the tangent to any point on the second trailing edge line and said radial section is equal to L4. The outlet of each of the second blades 222 is configured to bend forward and the range of L4 is limited, which facilitates reducing the airflow resistance and generating sufficient air pressure.

Figure 10:
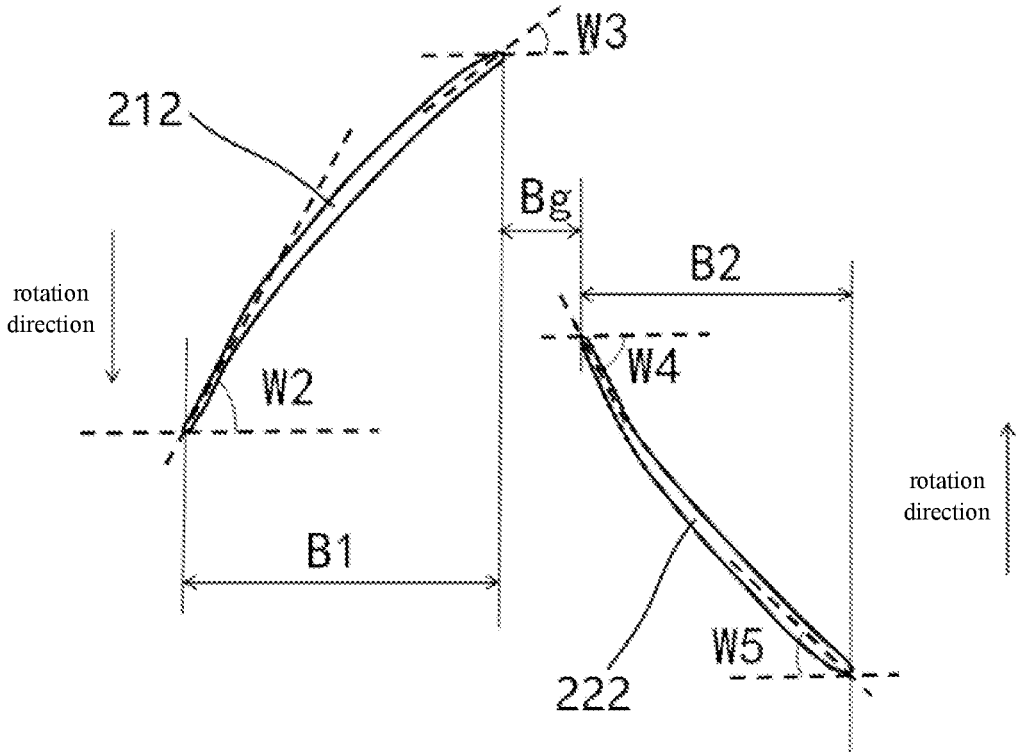
FIG. 10 is a diagram explaining definitions of parameters of a first blade and a second blade.

In some embodiments, as shown in FIG. 10, a difference between an outlet angle of each of the second blades 222 and an inlet angle of each of the first blades 212 is at most 10°, and a difference between an inlet angle of each of the second blades 222 and a reference angle of each of the first blades 212 is at most 5°. The reference angle of each of the first blades 212 is an arctangent function angle of a tangential value of the inlet angle of each of the first blades 212 after referencing to flow coefficients.

In one embodiment, as shown in FIG. 10, the inlet angle of each of the first blades 212 is denoted as W2, the inlet angle of each of the second blades 222 is denoted as W4, and the outlet angle of each of the second blades 222 is denoted as W5. W2 and W5 satisfy the relation of: $(W2-10°)\leq W5\leq(W2+10°)$, $(W4t-5°)\leq W4\leq(W4t+5°)$, in which $W4t=\arctan\{Fi*\tan(W2)/[Fi+\tan(W2)]\}$, and Fi represents flow coefficients.

It is understood that the magnitude of the inlet angle W1 of each of the first blades 212, the inlet angle W3 and the outlet angle W4 of each of the second blades 222 affect the air outlet characteristics of the first stage impeller 21 and the second stage impeller 22 to a certain extent. It has been proved through a number of tests that if the inlet angle W1 of each of the first blades 212, the inlet angle W3 and the outlet angle W4 of each of the second blades 222 satisfy the above-mentioned relation, the first stage impeller 21 and the second stage impeller 22 have better air outlet characteristics, greater outlet air flow rate and longer air blowing distance.

In some embodiments, an axial width of each of the first blades 212 is denoted as B1, and an axial width of each of the second blades 222 is denoted as B2. B1 and B2 satisfy the relation of: $1.4*B2\leq B1\leq 3*B2$. As can be known from FIG. 5, the axial width of the blade refers to the maximum axial dimension of the blade, that is, the length of the projected line segment when the blade is projected on the rotation axis of the impeller.

It is understood that, generally, the total axial width of the counter-rotating fan 100 is limited. A reasonable allocation of the axial width of the first blade 212 and the second blade 222 facilitates ensuring the air outlet characteristics of the counter-rotating fan 100. It has been proved through a number of tests that if B1/B2 is within a range of 1.4-3, the counter-rotating fan 100 has better air outlet characteristics. In this case, the outlet air flow rate of the counter-rotating fan 100 and the outlet air pressure are relatively large.

Herein, it should be noted that for the axial width, it is a problem worthy to study that how to allocate the limited axial width to the first stage impeller and the second stage impeller. For the second stage impeller 22, the outlet airflow of the first stage impeller 21 provides the reverse pre-swirl. For example, the first stage impeller 21 rotates clockwise, and a clockwise swirl is carried out by the airflow at the outlet of the first stage impeller 21. Furthermore, the second stage impeller 22 rotates counterclockwise, and a counterclockwise swirl is carried out by the airflow at the outlet of the second stage impeller 22. The first stage impeller and the second stage impeller rotate simultaneously, and eventually part of the swirl in the airflow at the outlet of the second stage impeller 22 may cancel with each other.

However, the more the swirl in the outlet airflow is, the stronger the working capacity of the fan is, that is, the greater the air flow rate and the air pressure are. In order to increase the swirl, the rotation speed of the rotor can be increased, or the blade profile can be modified. From the perspective of modifying the blade profile, the best solution is to increase the axial length of each of the first blades 212. If the axial length of each of the second blades 222 is increased, although the swirl will be increased, the outlet direction of the airflow deviates from the axis, resulting in a relatively short air blowing distance. However, if the axial length of each of the first blades 212 is increased, the swirl will be increased. Furthermore, since the airflow generated by the first blades 212 is superimposed on the airflow generated by the second blades 222, the outlet direction of the airflow will not deviate from the axis eventually according to the analysis result of the superposition of the vector of the airflow direction, ensuring a sufficiently long air blowing distance of the axial flow fan.

Herein, the reason why the increased axial length of each of the first blades 212 can increase the swirl is that the airflow can be diverted through a sufficient angle with a sufficiently long axial length, generating sufficient swirl. The first stage impeller 21 generates sufficient swirl. After the swirl generated by the second stage impeller 22 is superimposed, the remaining swirl is still sufficient, so that the final air flow rate and the air pressure of the counter-rotating fan 100 are relatively large.

In some embodiments, the axial gap between each first blade 212 and each second blade 222 is denoted as Bg, and the axial width of each first blade 212 is denoted as B1. Bg and B1 satisfy the relation of: $0.1*B1\leq Bg\leq 0.8*B1$. By projecting each first blade 212 and each second blade 222 on the rotation axis respectively, two collinear line segments can be formed. The length of the gap between the two line segments is equal to the axial gap Bg between each first blade 212 and each second blade 222.

It is understood that the size of the axial gap between each first blade 212 and each second blade 222 can directly affect the output wind field performance of the counter-rotating fan 100. If Bg/B1 is within a range of 0.1-0.8, the counter-rotating fan 100 may have better air outlet characteristics.

In one embodiment, Bg satisfies the relation of: $10\ mm\leq Bg\leq 15\ mm$. Of course, it should be noted here that the value of Bg is not limited to the above-mentioned range. In practical applications, Bg can be adaptively adjusted according to actual needs.

In some embodiments, the diameter of the first hub 211 at the air outlet side of the first hub is denoted as DH2, and the diameter of the second hub 221 is denoted as DH3. DH2 and DH3 satisfy the relation of: $0.9\leq DH2/DH3\leq 1.1$. It is understood that the magnitude of DH2/DH3 directly affects the superposition relationship between the wind field output by the first stage impeller 21 and the wind field output by the second stage impeller 22. According to a number of tests, if DH2/DH3 is within a range of 0.9-1.1, the wind field output by the first stage impeller 21 and the wind field output by the second stage impeller 22 are strongly influenced by each other, ensuring that the counter-rotation fan 11 outputs a wind field with larger output air pressure and longer air blowing distance. Of course, it should be noted here that the specific ratio of DH2 to DH3 can be adjusted according to actual needs, and is not limited to the above-mentioned range.

In an example shown in FIG. 1, the diameter DS1 of the rim of the first stage impeller 21 is equal to the diameter DS2 of the rim of the second stage impeller 22. However, if the diameter DS1 of the rim of the first stage impeller 21 is not equal to the diameter DS2 of the rim of the second stage impeller 22, the same function can be achieved.

In some embodiments, the number of the first blades 212 is denoted as BN1, and the number of the second blades 222 is denoted as BN2. BN1 and BN2 satisfy the relation of: $BN2-3 \leq BN1 \leq BN2+5$.

It is understood that the values of BN1 and BN2 directly affect the superposition relationship between the wind field of the first stage impeller 21 and the wind field of the second stage impeller 22. According to actual experiments, if BN1 and BN2 satisfy the relation of: $BN2-3 \leq BN1 \leq BN2+5$, the wind field of the first stage impeller 21 and the wind field of the second stage impeller 22 have a best superposition effect, better ensuring the air outlet characteristics of the counter-rotating fan 100. Of course, in other embodiments of the present disclosure, the values of BN1 and BN2 can be selected according actual needs, and are not limited to the above-mentioned range.

In FIG. 1, there is only one set of the first stage impeller 21 and the second stage impeller 22. In other embodiments of the present disclosure, there may be multiple sets of the first stage impeller 21 and the second stage impeller 22. In this case, the same function can be achieved.

In conclusion, the counter-rotating fan 100 in the embodiments of the present disclosure can reduce the noise and increase the air pressure by optimizing the structure and parameters of the flow guide structure 10 and the impeller assembly 20.

A counter-rotating fan 100 in one specific embodiment of the present disclosure is described below referring to FIG. 1 to FIG. 13.

Embodiment

The counter-rotating fan 100 in an embodiment of the present disclosure includes an air barrel 14, an air inlet grille 11, a first stage impeller 21, a first motor, a second stage impeller 22, a second motor and an air outlet grille 12. The first stage impeller 21 includes a plurality of first blades 212 circumferentially spaced from each other. The second stage impeller 22 includes a plurality of second blades 222 circumferentially spaced from each other. Pressure surfaces of the first blades 212 face toward suction surfaces of the second blades 222. The bending direction of each of the first blades 212 is opposite to the bending direction of each of the second blades 222. The air inlet grille 11 is provided with nine supporting guide vanes 111. A flow guide cover 13 is provided at the air inlet side of the air inlet grille 11, and the crosswind side of the flow guide cover 13 is a hemispherical surface.

Herein, the upper hemispherical surface of the flow guide cover 13 has a diameter of Ddao=0.9DH1. Each of the supporting guide vanes 111 has an inlet installation angle of blade profile of W0=0, an outlet installation angle of W1=30°, a bending angle of T0=35°, and a gap angle of Tg=5°. The second stage impeller 22 constituting the counter-rotating axial flow fan has a hub ratio of CD2=0.7.

In this embodiment, the blade profile relationship between the first stage impeller 21 and the second stage impeller 22 satisfies: W4=W1, $(W3t-5°) \leq W3 \leq (W3t+5°)$, B1=2.5B2, Bg=15 mm. The diameter of the rim of the first stage impeller and the diameter of the rim of the second stage impeller (DS1, DS2) are equal to each other. The number of blades of the first stage impeller is equal to the number of blades of the second stage impeller, in which BN1=BN2=7.

FIG. 11 shows a comparison result between the noise of the counter-rotating fan 100 of this embodiment and the noise of the counter-rotating fan 100 in which the flow guide cover 13 is removed according to the noise tests. It can be seen from this figure that in the case of different air flow rates, the arrangement of the flow guide cover 13 reduces the noise.

FIG. 12 shows a comparison result between the noise of the counter-rotating fan 100 of this embodiment and the noise of the counter-rotating fan 100 with a common air inlet grille 11 according to the noise tests. The common air inlet grille 11 here means that the grille bars thereof are not designed to bend. It can be seen from this figure that in the case of different air flow rates, the bend air inlet grille 11 of the embodiments of the present disclosure reduces the noise.

Comparing the counter-rotating fan 100 of this embodiment with a counter-rotating fan 100 of which the structure is not optimized as described above, it can be seen that the counter-rotating fan 100 of the embodiment of the present disclosure has a prominent pressure rise.

Throughout the description of the present disclosure, reference to "an embodiment," "some embodiments," "explanatory embodiment," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A counter-rotating fan, comprising:

an impeller assembly, the impeller assembly comprising a first stage impeller and a second stage impeller, a rotation direction of the first stage impeller and a rotation direction of the second stage impeller being opposite to each other, the first stage impeller comprising a first hub and a plurality of first blades connected to the first hub, the second stage impeller comprising a second hub and a plurality of second blades connected to the second hub, pressure surfaces of the plurality of first blades facing toward suction surfaces of the plurality of second blades, each of the plurality of first blades bending toward a rotation direction of the plurality of first blades in a direction from a blade root to a blade tip of each of the plurality of first blades, each of the plurality of second blades bending toward a rotation direction of the plurality of second blades in a direction from a blade root to a blade tip of each of the plurality of second blades; and an air guide structure, the air guide structure comprising an air inlet grille, the air inlet grille being arranged adjacent to the first stage impeller, the air inlet grille comprising a plurality of supporting guide vanes arranged in a circumferential direction, each of the plurality of supporting guide vanes bending in a direction toward an air outlet side, a bending direction of each of the plurality of supporting guide vanes being opposite to a rotation direction of the plurality of first blades, and an inlet installation angle of each of the plurality of supporting guide vanes being smaller than an outlet installation angle of each of the plurality of supporting guide vanes;

wherein the inlet installation angle of each of the supporting guide vanes is 0°, and the outlet installation angle of each of the supporting guide vanes is between 18° and 42°;

wherein a diameter of the first hub is gradually increased in a direction from an air inlet side to an air outlet side of the first hub;

a diameter of the first hub at the air inlet side is at range of 0.5 to 0.85 times of a diameter of the first hub at the air outlet side; and the diameter of the first hub at the air outlet side is at range of 0.25 to 0.45 times of a diameter of a rim of the first stage impeller.

2. The counter-rotating fan of claim 1, wherein the air guide structure comprises a flow guide cover provided at a center position of an air inlet side of the air inlet grille, and at least a portion of an air inlet side surface of the flow guide cover forms a flow guide surface, which extends away from an axis of the counter-rotating fan in a direction toward the first stage impeller.

3. The counter-rotating fan of claim 2, wherein the flow guide surface is a hemispherical surface, a diameter of the hemispherical surface is at least 0.8 times a diameter of the first hub at an air inlet side of the first hub, and the diameter of the hemispherical surface is at most 1.1 times the diameter of the first hub at the air inlet side of the first hub.

4. The counter-rotating fan of claim 1, wherein each of the plurality of supporting guide vanes bends from a root to a tip of each of the plurality of supporting guide vanes in a direction opposite to the rotation direction of the plurality of first blades, if an angle of 360° is averagely divided into multiple subangles with a number equal to a number of the plurality of supporting guide vanes, an average angle is equal to an angle value of each subangle, and the average angle is at least 4° greater than a bending angle of each of the plurality of supporting guide vanes, and is at most 15° greater than the bending angle of each of the plurality of supporting guide vanes.

5. The counter-rotating fan of claim 1, wherein a hub ratio of the second stage impeller is a ratio of a diameter of the second hub to a diameter of a rim of the second stage impeller, and is at least 0.45 and at most 0.7.

6. The counter-rotating fan of claim 5, wherein an inlet of each of the plurality of first blades bends backward, and a bending angle of the inlet of each of the plurality of first blades is denoted as L1, which satisfies a relation of: $5° \leq L1 \leq 12°$.

7. The counter-rotating fan of claim 6, wherein an outlet of each of the plurality of first blades bends forward, and a bending angle of the outlet of each of the plurality of first blades is denoted as L2, which satisfies the relation of: $3° \leq L2 \leq 15°$.

8. The counter-rotating fan of claim 7, wherein an inlet of each of the plurality of second blades bends backward, and a bending angle of the inlet of each of the plurality of second blades is denoted as L3, which satisfies the relation of: $5° \leq L3 \leq 10°$.

9. The counter-rotating fan of claim 8, wherein an outlet of each of the plurality of second blades bends forward, and a bending angle of the outlet of each of the plurality of second blades is denoted as L4, which satisfies the relation of: $3° \leq L4 \leq 8°$.

10. The counter-rotating fan of claim 1, wherein an axial width of each of the plurality of first blades is at least 1.4 times an axial width of each of the plurality of second blades, and is at most 3 times the axial width of each of the plurality of second blades.

11. The counter-rotating fan of claim 1, wherein an axial gap between each first blade and each second blade is at least 0.1 times an axial width of each of the plurality of first blades, and is at most 0.8 times the axial width of each of the plurality of first blades.

12. The counter-rotating fan of claim 1, wherein a diameter of the first hub at an air outlet side of the first hub is at least 0.9 times a diameter of the second hub, and is at most 1.1 times the diameter of the second hub.

13. The counter-rotating fan of claim 1, wherein a number of the plurality of first blades is greater than or equal to a number of the plurality of second blades minusing 3, and is less than or equal to a sum of a number of the plurality of second blades and claim 5.

14. The counter-rotating fan of claim 1, wherein the impeller assembly comprises multiple sets of impellers arranged in an axial direction.

15. The counter-rotating fan of claim 1, wherein a profile of each first blade is different from a profile of each second blade.

16. The counter-rotating fan of claim 1, wherein a diameter of a rim of each of the plurality of first blades is equal to a diameter of a rim of each of the plurality of second blades, or the diameter of a rim of each of the plurality of first blades is not equal to a diameter of the rim of each of the plurality of second blades.

* * * * *